US007248163B2

(12) United States Patent
Wu

(10) Patent No.: US 7,248,163 B2
(45) Date of Patent: Jul. 24, 2007

(54) KNOB ASSEMBLY WITH A LOCK AND A STATUS INDICATOR

(76) Inventor: Ting-Pin Wu, No. 147, Sec. 2, Mincyuan Rd., Jhongli City, Taoyuan Hsien (TW)

( * ) Notice: Subject to any disclaimer, the term of this patent is extended or adjusted under 35 U.S.C. 154(b) by 186 days.

(21) Appl. No.: 11/101,920

(22) Filed: Apr. 8, 2005

(65) Prior Publication Data

US 2006/0227000 A1 Oct. 12, 2006

(51) Int. Cl.
*E05B 45/06* (2006.01)

(52) U.S. Cl. ..... 340/542; 70/432; 200/61.64; 340/691.1; 340/815.45

(58) Field of Classification Search ..... 340/542, 340/691.1, 815.45; 70/432, 101; 200/61.64
See application file for complete search history.

(56) References Cited

U.S. PATENT DOCUMENTS 4,683,741 A * 8/1987 Fields ..... 70/432
4,760,380 A * 7/1988 Quenneville et al. ..... 340/542
4,901,057 A * 2/1990 Suneborn ..... 340/542
5,111,007 A * 5/1992 Miller et al. ..... 340/815.45

* cited by examiner

*Primary Examiner*—Thomas Mullen
(74) *Attorney, Agent, or Firm*—Alan Kamrath; Kamrath & Associates PA

(57) ABSTRACT

A knob assembly with lock and a status indicator is mounted in a toilet stall door and has a tubular lock, an indicator and a battery container. The tubular lock is mounted through door. The indicator is mounted on an outer surface of the tubular lock. When the toilet stall door is locked, the indicator emits light. Consequently, people are able to determine the door is locked. With a clear and visible indication that the toilet stall door is locked, people will not push the door so the door will not be damaged.

7 Claims, 9 Drawing Sheets

KNOB ASSEMBLY WITH A LOCK AND A STATUS INDICATOR

BACKGROUND OF THE INVENTION

1. Field of the Invention

The present invention relates to a knob assembly with a lock and, more particularly, to a knob assembly with a lock and a status indicator that indicates when the lock is locked.

2. Description of Related Art

Most public facilities, such as schools, movie theaters, subway stations, amusement parks and the like have public restrooms. Most toilets have locks on the doors to ensure privacy.

However, the lock status indicators on toilet stall doors are often difficult to see, and people must push the doors to determine whether or not the stall door is unlocked. In the urgency of locating a vacant toilet stall, people often push the stall doors with excessive force. The excessive force eventually damages the stall doors or the locks so the stall doors cannot be locked.

To overcome the shortcomings, the present invention provides a lock with a status indicator to obviate or mitigate the aforementioned problems.

SUMMARY OF THE INVENTION

The primary object of the present invention is to provide a knob assembly with a lock and a status indicator that clearly indicates when a toilet stall is locked.

The knob assembly with a lock and a status indicator has a knob, a tubular lock and an indicator. The knob is mounted in a door, and the tubular lock is mounted in the knob. The indicator is mounted on an outer escutcheon on the tubular lock. When the toilet stall is locked, the indicator emits light so people are able to determine if the door is locked. With a clear and visible indication that the toilet stall is locked, people will not push the door so the door will not be damaged.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
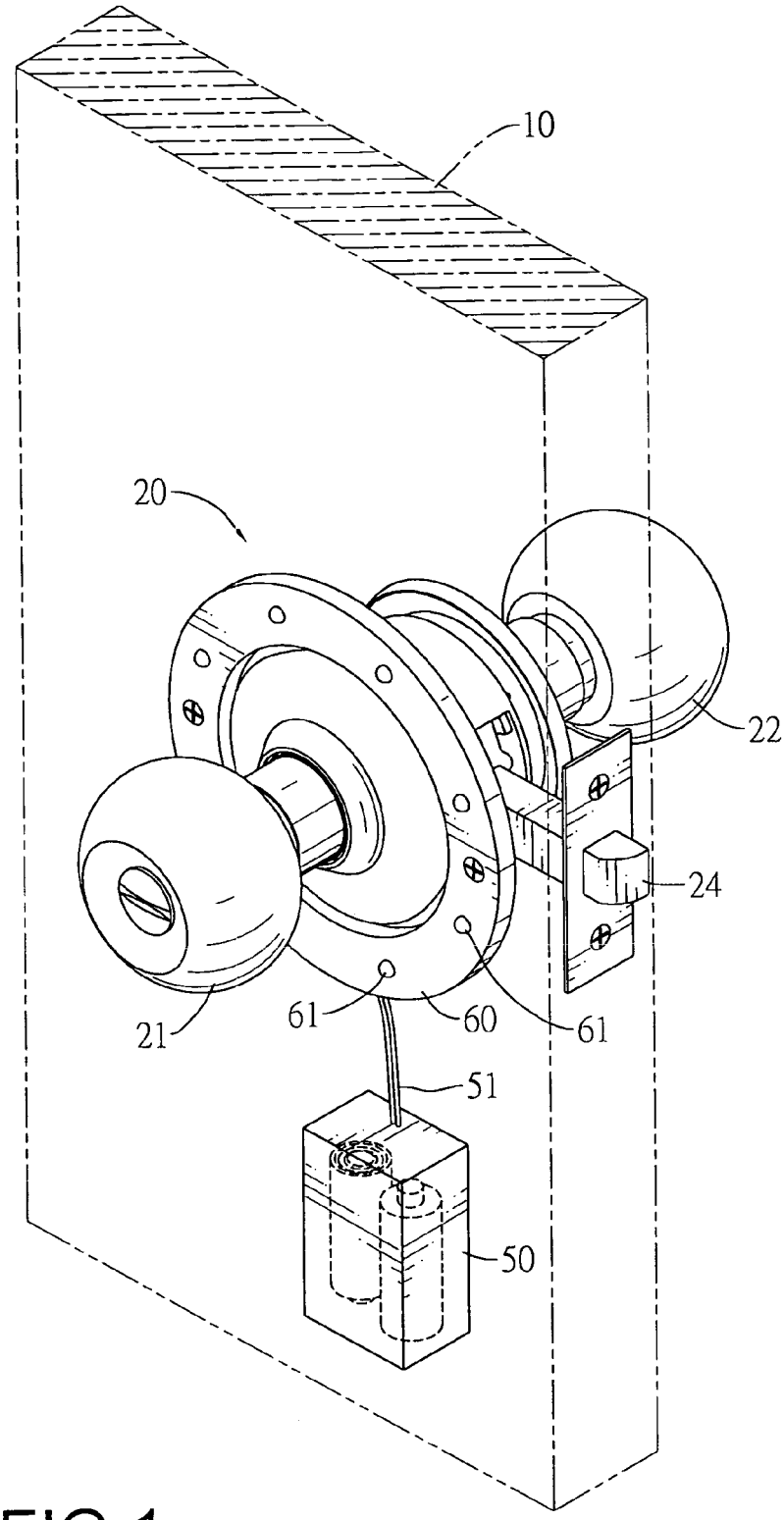
FIG. 1 is a perspective view of a knob assembly with a lock and a status indicator in accordance with the present invention.

With reference to FIGS. 1, 2, 3 and 6, a knob assembly with a lock and a status indicator in accordance with the present invention is mounted in a door (10) and comprises a tubular lock (20), an indicator and a battery container (50). A door (10) has an inside surface and an outside surface.

The tubular lock (20) is mounted through the door (10) and has a body (23), an inner knob (22), an optional outer knob (21), a latch (24), a shaft (30, 30A), a pushing rod (41, 41A) and an optional switch bracket (25) and a switch (26).

The body (23) is mounted in the door (10) and has an outer surface, an inner surface, an inner side and an outer side.

The inner knob (22) is mounted rotatably on the inner surface of the body (23) and has a through hole. The through hole is formed through the inner knob (22).

The outer doorknob (21) is mounted rotatable on the outer surface of the body (23).

The latch (24) is mounted slidably on the outer side of the body (23).

The shaft (30, 30A) is hollow, is mounted inside the body (23) and has a side, an inner surface and a slot (31, 31A). The slot (31, 31A) is formed longitudinally through the side of the shaft (30, 30A).

The pushing rod (41, 41A) is mounted slidably in the shaft (30) between the body (23) and the inner knob (22) and has an inner end, an outer end, an optional side, an optional edge, an optional inclined protrusion (42) and a button (40). The inclined protrusion (42) is formed on the edge at and protrudes perpendicular from the inner end of the pushing rod (41, 41A) and is slidably mounted in the slot (31, 31A) in the shaft (30, 30A). The button (40) is mounted on the outer end of the pushing rod (41, 41A) and extends out of the through hole in the inner knob (22).

The pushing rod (41A) in a second embodiment of the knob assembly in accordance with the present invention has an optional tab (43) attached to the side of the pushing rod (41A).

In a first embodiment of the knob assembly with a lock and a status indicator in accordance with the present invention, the switch bracket (25) is mounted on the inner side of the body (23) and has an inner surface.

The switch (26) is mounted on the body (23), is activated by the pushing rod (41) and has a trigger. The trigger is depressed selectively by the pushing rod (41) to activate the switch (26) when the button (40) is pushed into the inner knob (22) to lock the knob assembly.

Figure 4:
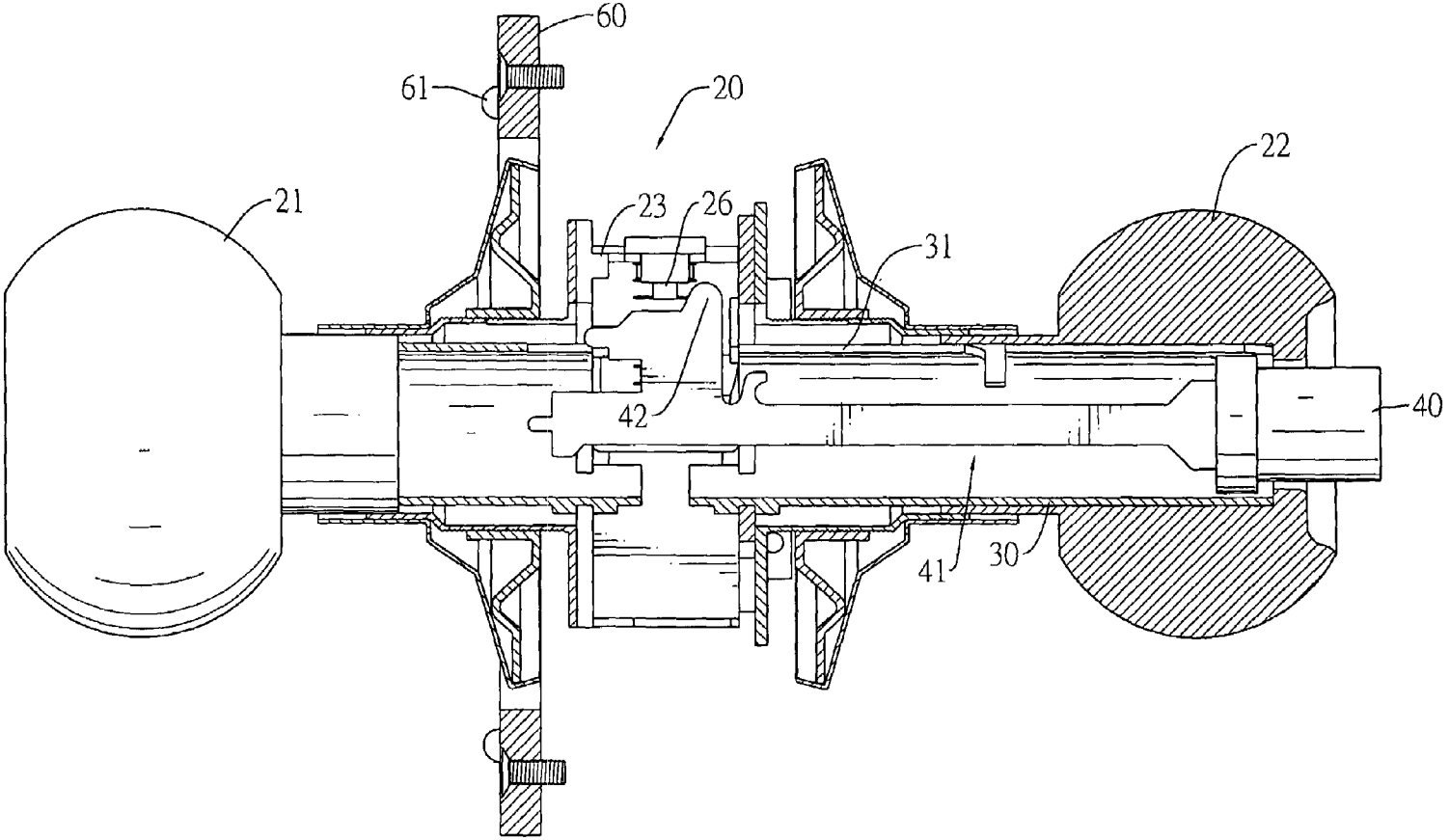
FIG. 4 is a side view in partial section of the knob assembly in FIG. 3.
Figure 5:
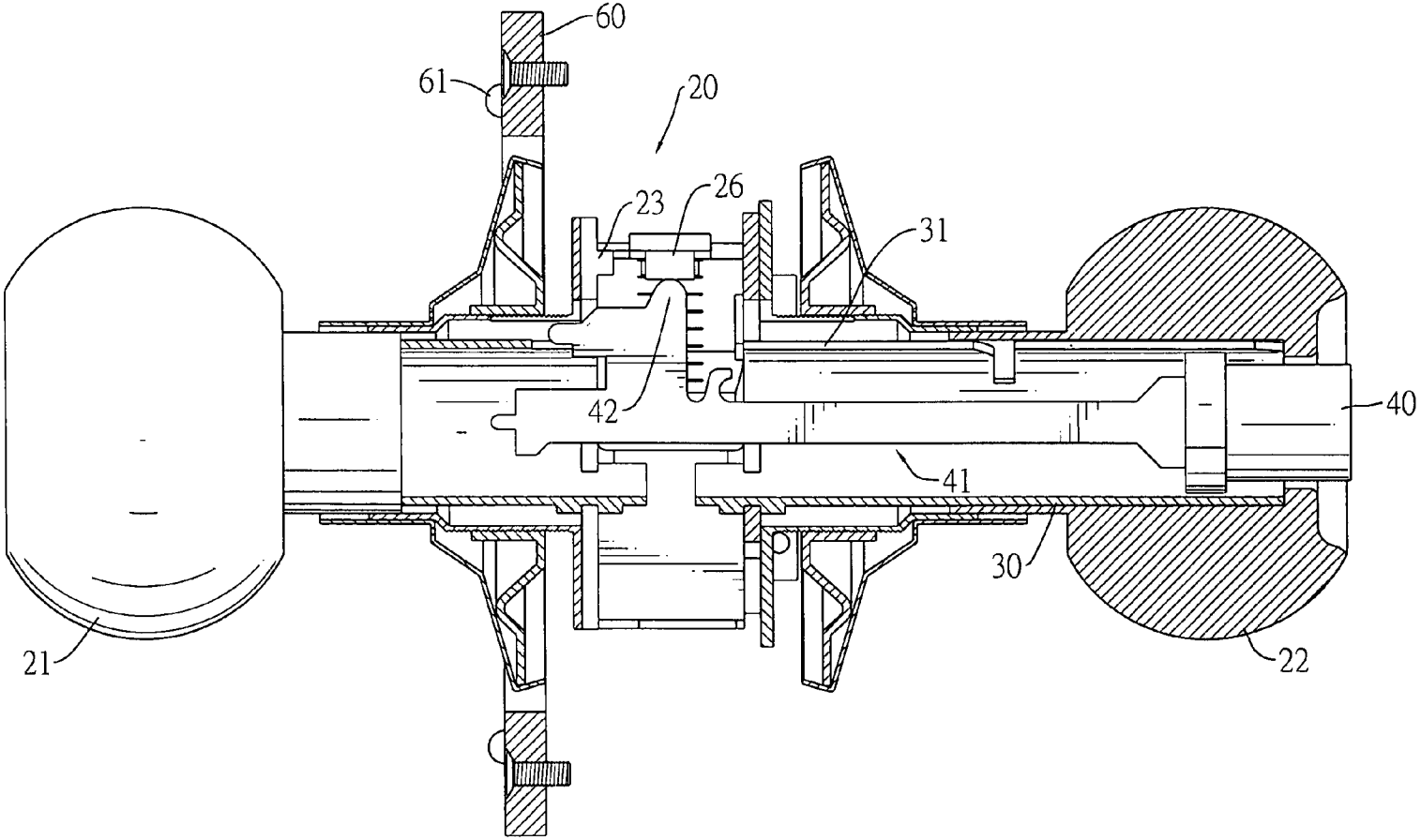
FIG. 5 is an operational side view in partial section of the knob assembly in FIG. 3 when the status indicator is activated.
Figure 6:
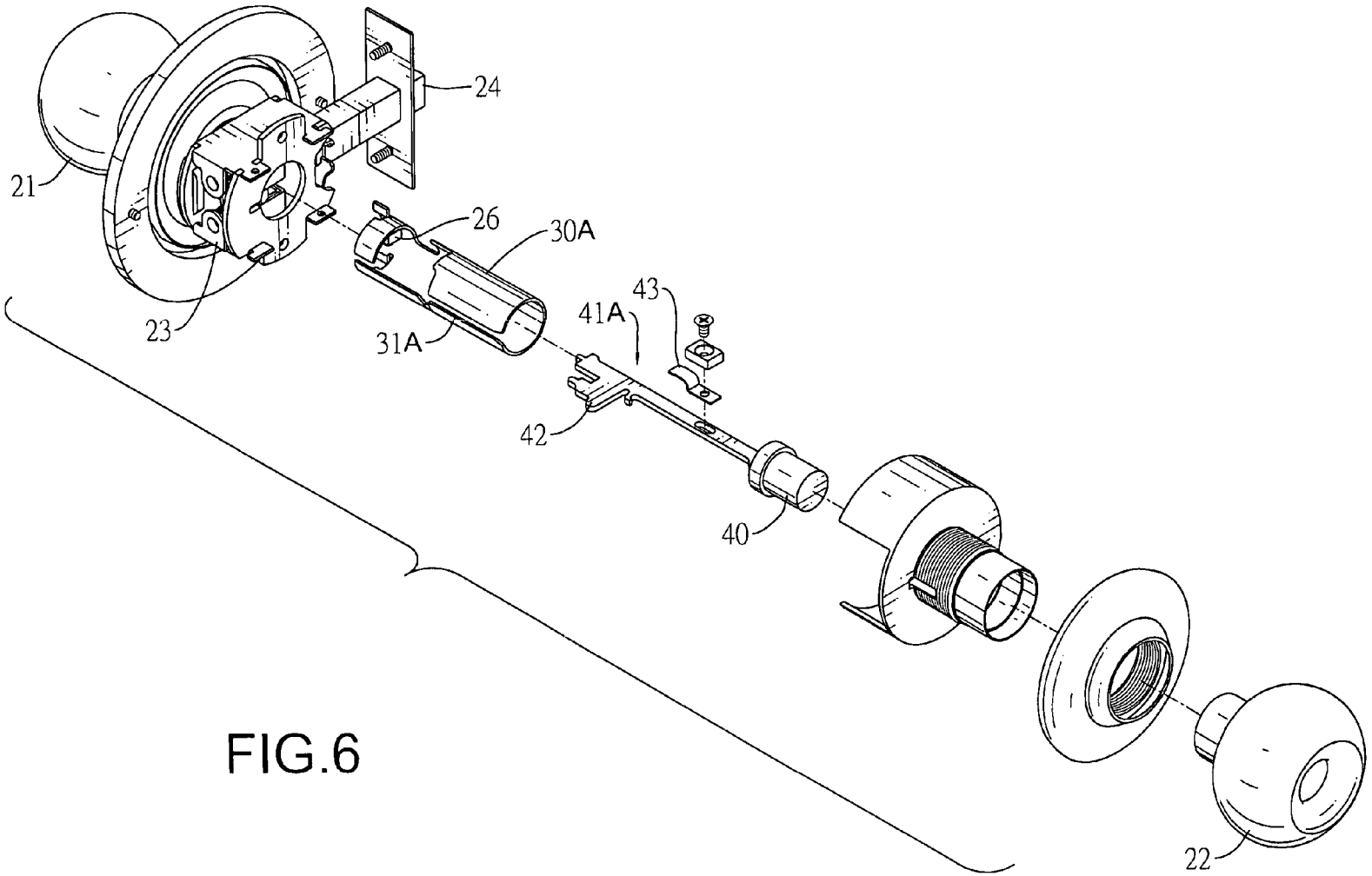
FIG. 6 is an exploded perspective view of a second embodiment of the knob assembly in FIG. 2.

In the first embodiment of the knob assembly with a lock and a status indicator, the switch (26) is mounted on the inner surface of the switch bracket (25). The trigger of the switch (26) extends into the body (23) and is selectively pressed by the inclined protrusion (42) on the pushing rod (41). With reference to FIGS. 4 and 5, the switch (26) is activated when the trigger of the switch (26) is pressed by the inclined protrusion (42) on the pushing rod (41).

Figure 7:
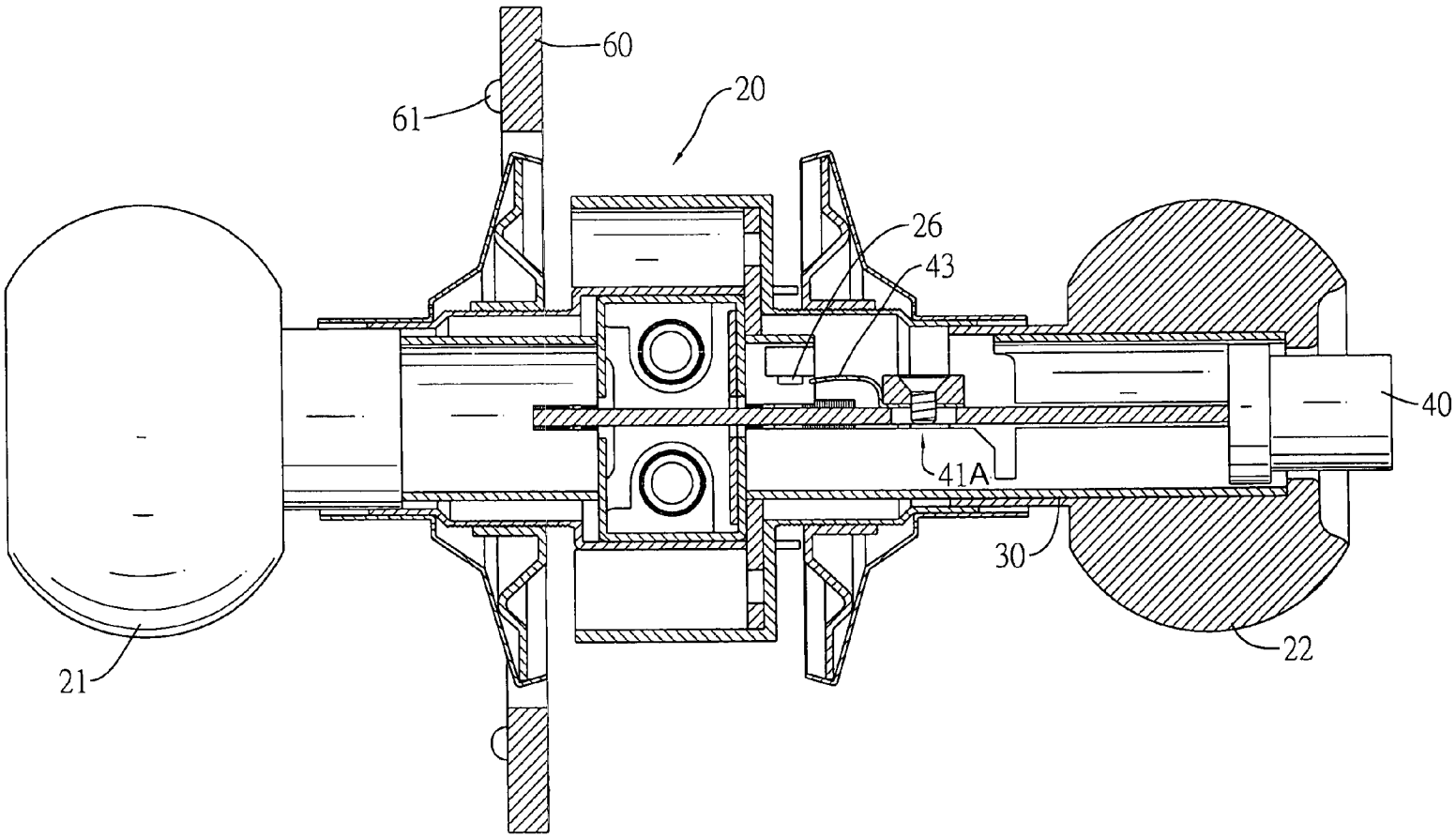
FIG. 7 is a side view in partial section of knob assembly in FIG. 6.
Figure 8:
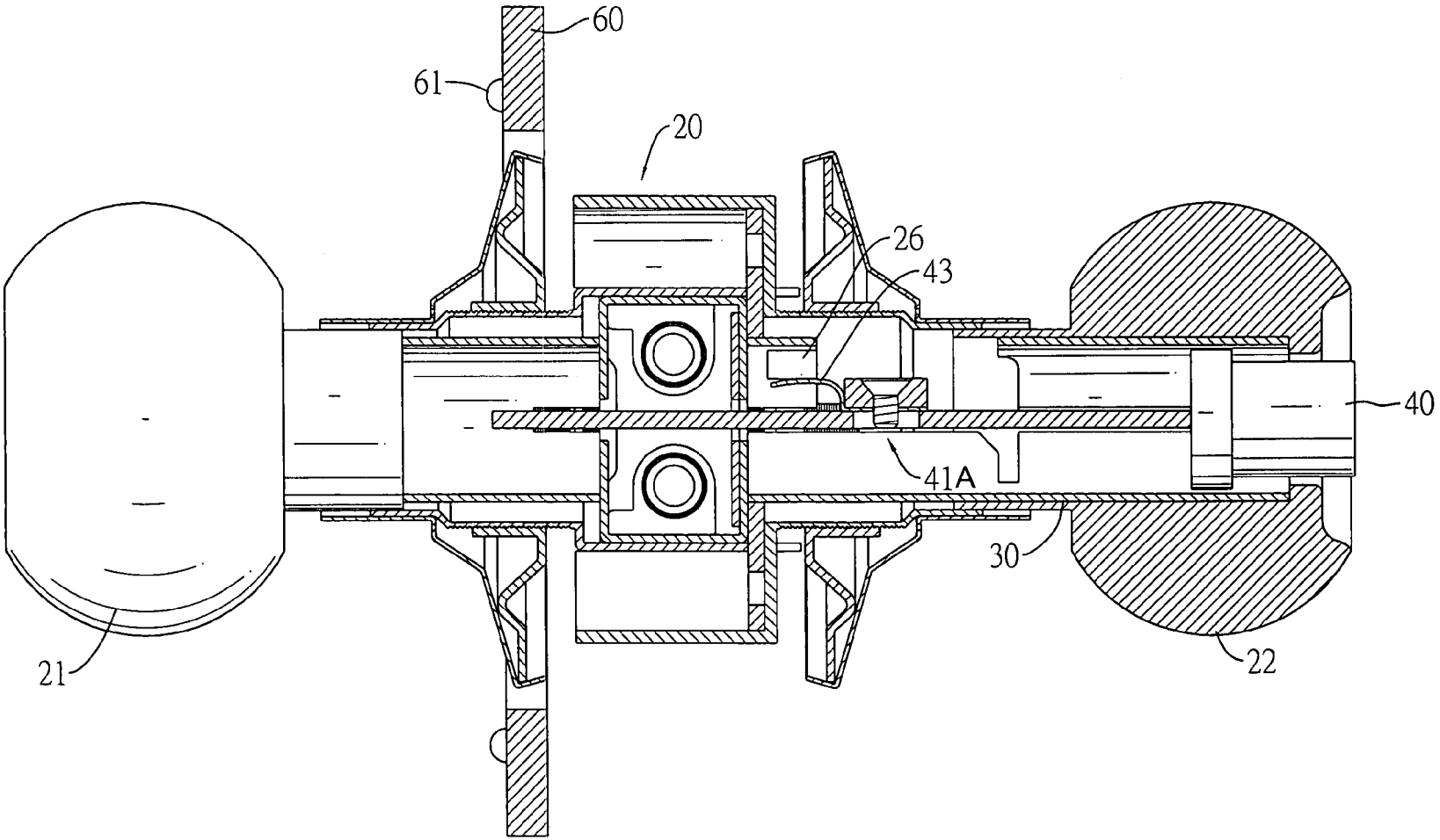
FIG. 8 is an operational side view in partial section of the knob assembly in FIG. 6 when the status indicator is activated.

In the second embodiment of the knob assembly with a lock and a status indicator, the switch (26) is mounted on the inner surface of the shaft (30A). With further reference to FIGS. 7 and 8, the trigger on the switch (26) is selectively pressed by the tab (43) on the pushing rod (41A) to activate the switch (26).

Figure 2:
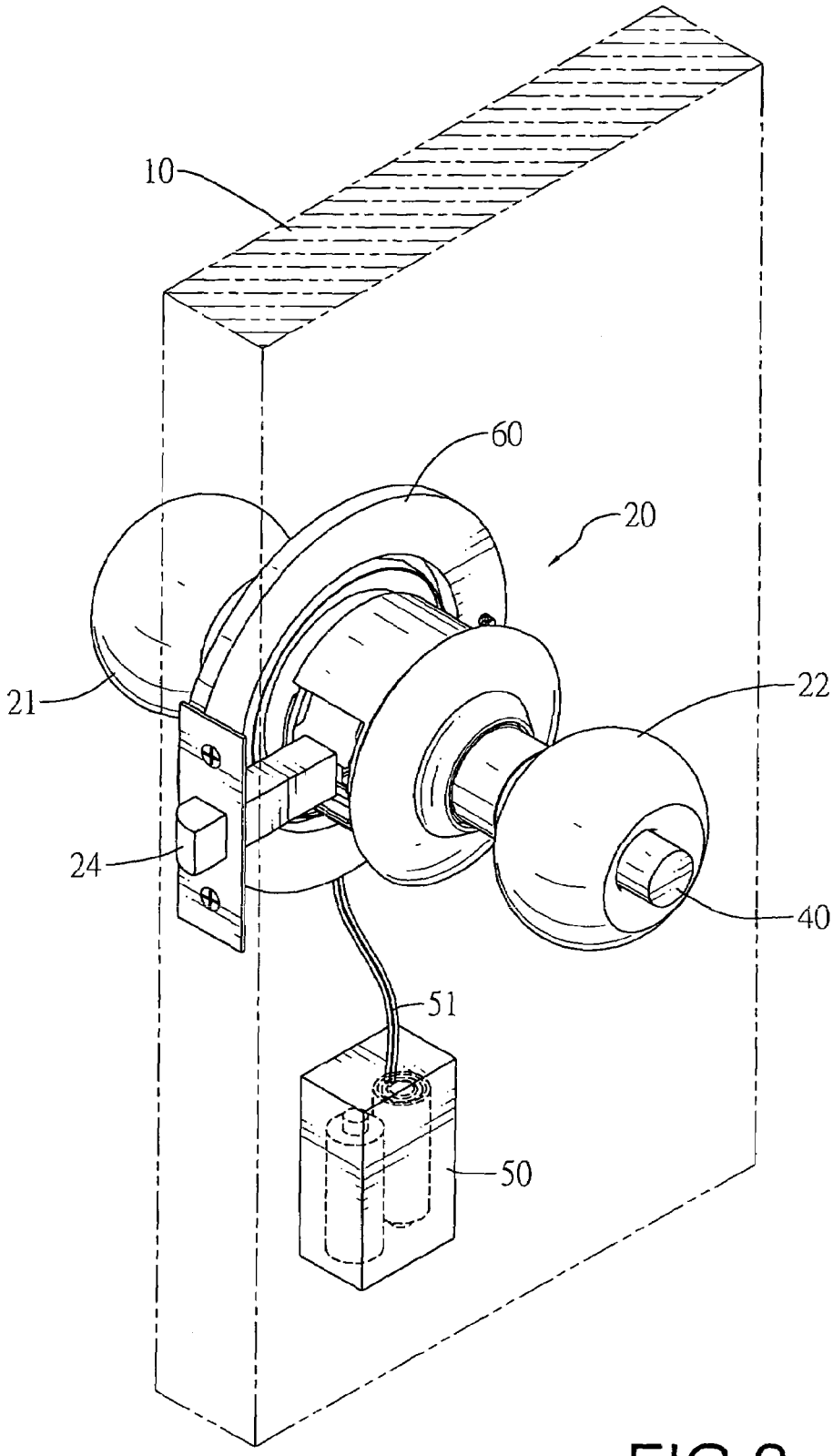
FIG. 2 is a perspective view of the knob assembly with a lock and a status indicator in accordance with the present invention.
Figure 3:
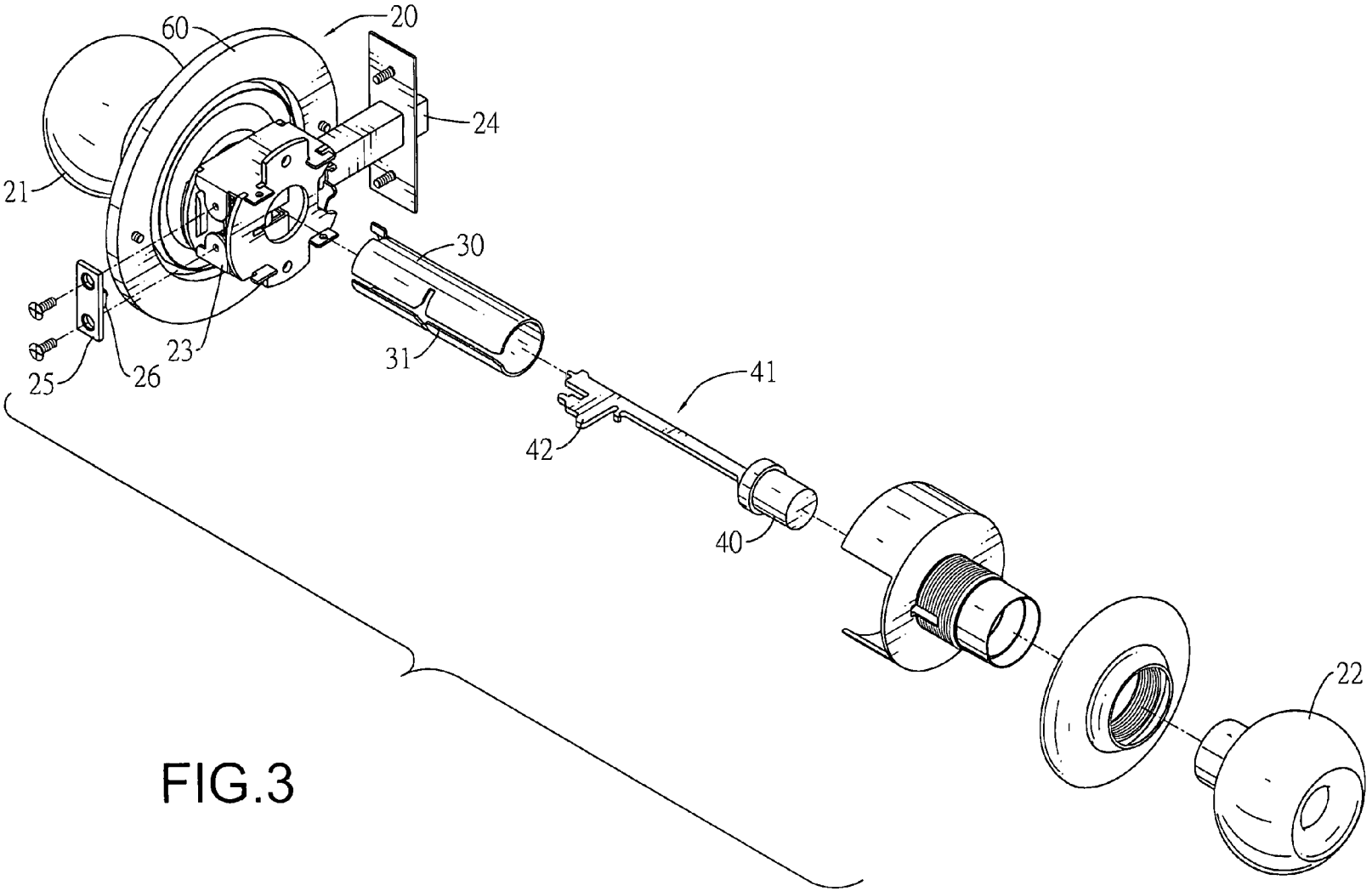
FIG. 3 is an exploded perspective view of a first embodiment of the knob assembly in FIG. 2.
Figure 9:
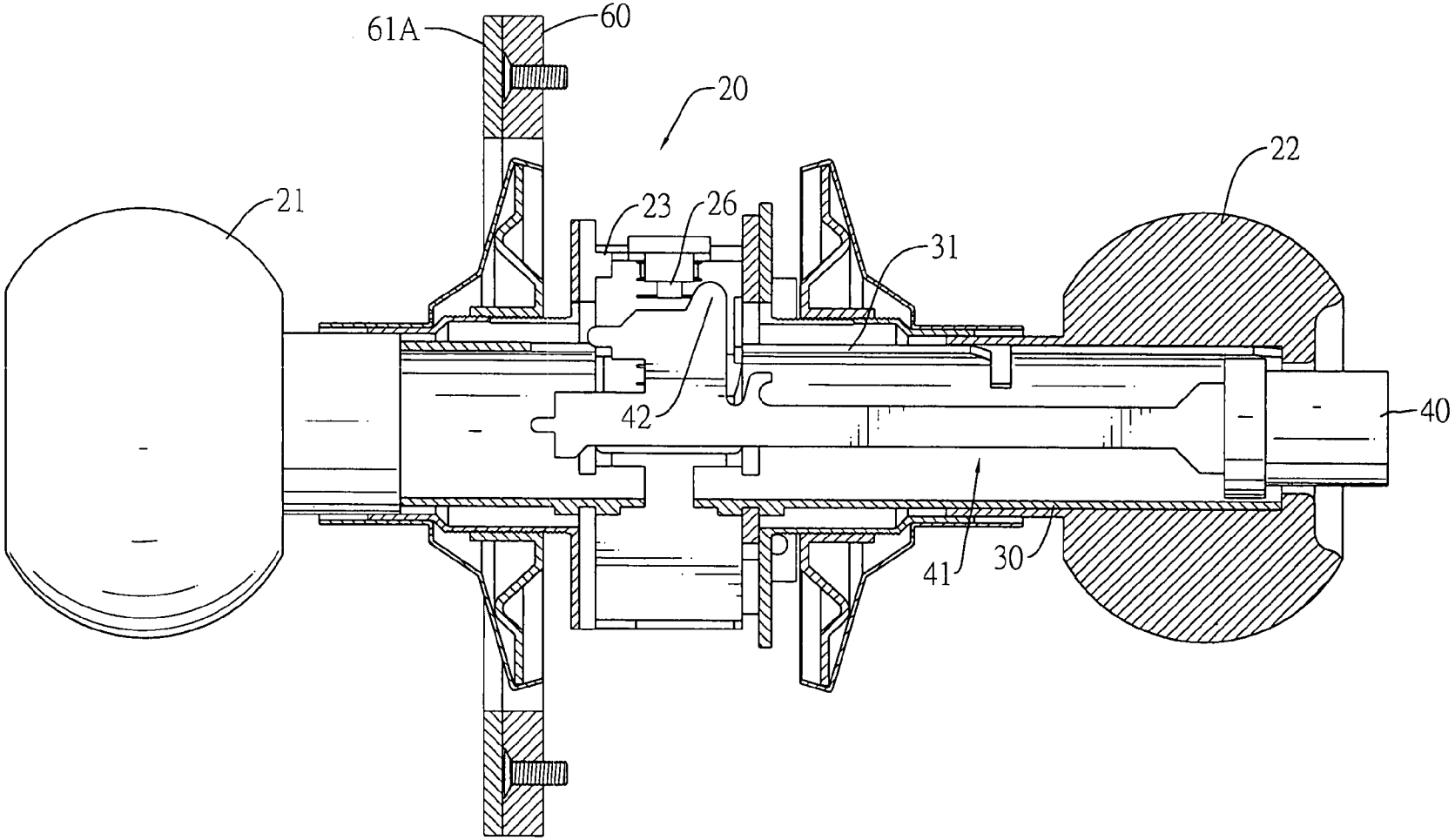
FIG. 9 is a side view in partial section of a third embodiment of the knob assembly in FIG. 2.

With reference to FIGS. 1, 2 and 9, the indicator has a panel (60) and an illuminating device (61, 61A). The panel (60) is mounted on the outer surface of the body (23). The illuminating device (61, 61A) is mounted on the panel (60).

In the first embodiment of the knob assembly with a lock and a status indicator, the illuminating device (61) is multiple light-emitting diodes.

In a third embodiment of the knob assembly with a lock and a status indicator in accordance with the present invention, with further reference to FIG. 9, the illuminating device (61A) is a luminescent card.

The battery container (50) is mounted on the inside surface of the door (10) and has a least one battery and multiple electrical leads (51). The battery is mounted in the battery container (50). The electrical leads (51) are connected to the switch (26), the at least one battery and the illuminating device (61, 61A) to control the illuminating device (61, 61A).

In conclusion, the emitting illuminating device (61, 61A) indicates that the public toilet stall is locked. So people will not need to push the door (10) to determine whether or not the stall is locked. Consequently, the door (10) is less likely to be damaged and will provide effective privacy longer.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A knob assembly with a lock and a status indicator for being mounted in a door with an inside surface and an outside surface, and the knob assembly comprises a tubular lock having a body adapted to be mounted in the door and having an outer surface;

an inner surface;

an inner side; and an outer side;

an inner doorknob mounted rotatably on the inner surface of the body and having a through hole formed through the inner doorknob;

a latch mounted slidably on the outer side of the body;

a shaft being hollow, mounted inside the body and having a side;

an inner surface; and a slot formed longitudinally through the side of the shaft;

a pushing rod mounted slidably in the shaft between the body and the inner knob and having an inner end;

an outer end; and a button mounted on the outer end of the pushing rod and extending out of the through hole in the inner knob;

a switch mounted on the body, activated by the pushing rod and having a trigger depressed selectively by the pushing rod to activate the switch;

an indicator having a panel mounted on the outer surface of the body; and an illuminating device mounted on the panel; and a battery container mounted on the inside surface of the door and having at least one battery mounted in the battery container; and multiple electrical leads connected to the switch, the at least one battery and the illuminating device to control the illuminating device.

2. The knob assembly with a lock and a status indicator as claimed in claim 1, wherein the pushing rod further has an edge; and an inclined protrusion formed on the edge at and protruding from the inner end of the pushing rod and slidably mounted in the slot in the shaft;

the body further has a switch bracket mounted on the inner side of the body;

the switch bracket has an inner surface; and the switch is mounted on the inner surface of the switch bracket and is selectively activated by the inclined protrusion.

3. The knob assembly with a lock and a status indicator as claimed in claim 2, wherein the illuminating device is a luminescent card.

4. The knob assembly with a lock and a status indicator as claimed in claim 2, wherein the illuminating device is multiple light-emitting diodes.

5. The knob assembly with a lock and a status indicator as claimed in claim 1, wherein the pushing rod further has a side; and a tab attached to the side of the pushing rod;

the switch is mounted on the inner surface of the shaft; and the trigger of the switch is selectively pressed by the tab on the pushing rod to activate the switch.

6. The knob assembly with a lock and a status indicator as claimed in claim 5, wherein the illuminating device is multiple light-emitting diodes.

7. The knob assembly with a lock and a status indicator as claimed in claim 1 wherein the knob assembly further comprises an outer doorknob mounted rotatably on the outer surface of the body.

* * * * *